US006125930A

United States Patent [19]

Moyes

[11] Patent Number: 6,125,930

[45] Date of Patent: Oct. 3, 2000

[54] DOWNHOLE VALVE

[75] Inventor: Peter Barnes Moyes, Westhill, United Kingdom

[73] Assignee: Petroline Wellsystems Limited, Scotland, United Kingdom

[21] Appl. No.: 09/000,292

[22] PCT Filed: Jul. 26, 1996

[86] PCT No.: PCT/GB96/01798

§ 371 Date: Jan. 26, 1998

§ 102(e) Date: Jan. 26, 1998

[87] PCT Pub. No.: WO97/05362

PCT Pub. Date: Feb. 13, 1997

[30] Foreign Application Priority Data

Jul. 26, 1995 [GB] United Kingdom ..... 9515362

[51] Int. Cl.[7] ..... E21B 34/10; E21B 34/12; E21B 47/10

[52] U.S. Cl. ..... 166/66; 166/66.7; 166/317; 166/324

[58] Field of Search ..... 166/323, 324, 166/317, 321, 66.6, 66.7, 320, 66

[56] References Cited

U.S. PATENT DOCUMENTS

| | | | |
|---|---|---|---|
| 4,100,969 | 7/1978 | Randermann, Jr. . | |
| 4,364,587 | 12/1982 | Samford | 285/3 |
| 4,378,842 | 4/1983 | Patel | 166/317 X |
| 4,694,903 | 9/1987 | Ringgenberg . | |
| 4,712,613 | 12/1987 | Nieuwstad . | |
| 4,724,908 | 2/1988 | Pringle . | |
| 4,941,534 | 7/1990 | Berzin . | |

FOREIGN PATENT DOCUMENTS

| | | |
|---|---|---|
| 0 551 163 | 7/1993 | European Pat. Off. . |
| 2 140 486 | 11/1984 | United Kingdom . |
| 93/03255 | 2/1993 | WIPO . |

*Primary Examiner*—George Suchfield
*Attorney, Agent, or Firm*—Alston & Bird LLP

[57] ABSTRACT

A downhole check valve includes a body (32) defining a flow passage and a valve assembly (34, 42, 44) mounted in the body, the valve assembly including a valve member (34) movable from a first configuration to a second configuration. In the first configuration the valve member prevents flow in one direction through the passage, and in the second configuration the valve member is retained in an open position. A valve member retaining sleeve (48) is normally restrained in a first configuration and biassed for movement to a second configuration. The retainer is held in the first configuration while the valve member (34) is in the first configuration and is releasable from the first configuration to move the valve member to the open position and retain the valve member in the open position.

32 Claims, 8 Drawing Sheets

DOWNHOLE VALVE

This invention relates to a valve particularly useful in downhole applications.

In the oil and gas exploration and production industry, drilled bores are lined with steel tubing which is secured in the bore with cement: in the upper section of a bore a steel casing is provided; and a steel liner is provided in the lowermost section of the bore which intersects the oil or gas bearing strata, known as the production or pay zone. In addition, production tubing may be provided within the casing, for carrying oil or gas to the surface from the production zone. The upper end of the production tubing is located relative to the casing by a tubing hanger and the lower end of the tubing is located relative to the casing by a packer, typically in the form of a flexible element mounted on the exterior of the production tubing and which is inflated to engage the casing.

It is essential that the production tubing, formed of a large number of tubing lengths which have been threaded together, is pressure-tight, and also that the tubing hanger is pressure tight. Further, the connection between top of the liner and the lower end of the casing must be secure and pressure-tight. Testing the "completion" of the tubing and the integrity of the liner/casing connection or liner hanger is achieved by providing valves at appropriate locations in the tubing and liner and then pressurising the tubing and liner above the respective valve using pumps on the surface. The integrity of the tubing hanger is tested by blanking of the tubing and pressurising the annulus between the tubing and the casing below the hanger. A similar valve is also provided, between the valves mentioned above, to allow the packer to be set by pressurised fluid which passes through suitable ports in the tubing above the closed packer setting valve to inflate the packer.

both the tubing and the liner are installed with the valves in position, located in suitable nipple profiles. The valves are normally closed but will open in response to a pressure force from below such that well fluid may flow into the tubing or liner as it is lowered into the bore. The tubing test valve is the first to be used, and may be utilised on a number of occasions to test the completion of sections of production tubing being added to the production string. When the entire production string is in place and has been tested, the valve is removed from the tubing using wireline, coil tubing or the like in conjunction with a suitable fishing tool. As mentioned above, the tubing hanger is tested by blanking off the tubing at the surface and pressurising the annular between the tubing and the casing below the hanger.

The packer is then set by pumping down on the packer setting valve. Once the packer has been set, the valve is removed from the tubing.

Finally, the integrity of the liner/casing connection is checked by pumping down on the top of the liner test valve. This lowermost valve is then removed.

The valves used for these applications are running standing valves and, as noted above, the valves must be removed from the tubing and the liner after use. This involves at least three runs of wireline or the like, and experience has shown that for various reasons the valves are often difficult to remove, and even straightforward valve removal operations take a considerable time to complete. Coupled with the requirement to provide a wireline or coil tubing rig and operator, and resulting valve removal operation is thus relatively expensive and time-consuming, particularly in offshore operations.

It is among the objects of embodiments of the present invention to obviate or mitigate these disadvantages.

According to one aspect of the present invention there is provided a downhole valve including:

a body defining a flow passage;

a valve assembly mounted in the body, the valve assembly including a valve member being movable from a first configuration to a second configuration, in the first configuration the valve member preventing flow in at least one direction through the passage, and in the second configuration the valve member being retained in an open position; and a valve member retainer normally restrained in a first configuration and biased for movement to a second configuration, the retainer being held in the first configuration while the valve member is in the first configuration and being releasable from said first configuration to move the valve member to the open position and retain the valve member in the open position.

The invention permits use of a valve which is fixed in a length of tubing in applications where the valve is only required for, for example, initial testing of the pressure-tightness of the tubing. With the present invention the valve may be utilised initially in the first configuration as a check valve and then, once testing is completed, the valve member is moved to the second configuration to allow unrestricted flow through the tubing such that there is no requirement to remove the valve from the tubing. Embodiments of the present invention may serve as tubing test vales, packer setting valves, or top of liner test valves, as will be described.

Preferably, in the first configuration, the valve member is normally closed and will hold pressure from said one direction but will open in response to pressure from the opposite direction. This permits the valve to be utilised in completion testing, where the valve must hold pressure from the surface side but opens in response to pressure from the sump side, to permit the tubing to fill with well fluid as it is lowered into a bore.

Preferably also, the valve member retainer is biassed towards its second configuration by a spring.

Preferably also, the valve member retainer is released from its first configuration by axial movement of the valve assembly relative to the valve body. The axial movement of the valve assembly may result in release of a trip coupling, such as trip keys. The axial movement may be achieved by application of a pressure force to the valve member or to a portion of the valve assembly. In one embodiment the pressure force may be applied directly to the valve member by fluid in the tubing, while in another embodiment the pressure force may be applied by a separate source of fluid pressure, such as an explosive charge.

Axial movement of the valve assembly relative to the body may be resisted by a biassing member, such as a spring. The biassing member may thus be pre-stressed such that the degree of axial movement necessary to release the valve member retainer is only obtained by application of a pressure above a predetermined level to the valve member or valve assembly. Alternatively, or in addition, the valve assembly may be initially coupled to the body to prevent relative movement therebetween and may be uncoupled to permit release of the valve member retainer. In one embodiment the coupling may be in the form of a shear coupling or other coupling that will release on application of a predetermined force. Alternatively, the coupling may include a coupling member which may be retracted or otherwise configured to permit uncoupling; preferably, a coupling member actuator is provided and may be remotely activated to permit uncoupling. In one embodiment the coupling member actuator is an electric motor which may be activated by pressure pulses.

Preferably also, the valve assembly includes a portion for closing a port in the wall of the body, which port may communicate with a control line linked to a packer or other fluid actuated downhole tool. The valve assembly portion initially closes the port but is movable to permit fluid flow through the port from the body passage.

Preferably also, the valve assembly includes a valve member carriage and the released retainer is movable relative thereto. Where the valve member is a ball, the carriage may include a ball cage and the released retainer may be movable relative to the cage.

Preferably also, the retainer includes an axially movable sleeve defining a portion of the valve flow passage. Where the valve is a ball valve, an end of the sleeve may contact the ball surface and push the ball to the open position. Where the valve member is in the form of one or more flappers, an end of the sleeve may push the flappers to the open position and then define the flow passage past the flappers.

In one embodiment of the invention, the valve member ay be configured to permit limited flow of fluid in said one direction. This may be achieved by providing a further valve including a normally open valve member which remains open where there is only a limited flow in said one direction, but closes in response to a higher rate of flow. Such a valve may include a valve member which is normally lifted from its seat by a spring, such that fluid may pass around the member. However, a higher flow creates a pressure force on the valve member and overcomes the spring force to close the valve. Conveniently, the valve member is in the form of a ball. This further valve may be provided in the main valve member, as described above. Alternatively, a normally open ball valve may be provided in combination with a valve actuator defining a piston, venturi or other restriction above the ball; a restricted flow of fluid will pass through the valve, but a greater flow rate will create a pressure force to push the ball to the closed position. These embodiments have particular application in situations where two valves are provided in a length of tubing and the upper valve will be used and then moved to the open second configuration before utilising the second valve. If the second valve is one which may be moved to the second configuration in response to fluid pressure applied from the fluid in the tubing, there is a risk that any leakage past the first valve will cause the second valve to move to the open second configuration. Providing an additional normal open valve in the second valve obviates this risk, as any leakage will simply pass through the second valve, avoiding any pressure build in between the valves. However, once the first valve has been opened, a higher flowrate will close the normally open valve and permit the second valve to operate as normal, and also permit movement of the second valve to the second configuration.

In accordance with another aspect of the present invention there is provided a downhole check valve comprising:

a body defining a flow passage;

a valve assembly mounted in the body, the valve assembly including: a primary valve member being movable from a first configuration to a second configuration, in the first configuration the valve member preventing flow in at least one direction through the passage, and in the second configuration the valve member being retained in an open position; and a normally open secondary valve member configured to permit flow in said one direction through said primary valve member up to a predetermined rate and being closed by fluid forces in the event of the flow rate approaching said predetermined rate. Preferably, the secondary valve member is located on the primary valve member and controls flow through a passage extending therethrough.

According to another aspect of the present invention there is provided downhole apparatus including:

a body;

a member mounted on the body and being movable relative thereto;

a coupling between the body and the member, in a first configuration the coupling preventing movement of the member relative to the body and in a second configuration the coupling permitting such movement;

a coupling actuator for moving the coupling from the first to the second configuration;

a sensor operatively associated with the coupling actuator and for activating the actuator on detection of a predetermined activation signal.

The member may be part of a valve, the valve being locked in a closed first configuration by the coupling and being movable to an open second configuration on reconfiguring of the coupling. The valve may control flow of fluid through an axial passage defined by the body, or may control flow of fluid through a wall of the body, for example between an axial body passage and an annulus between the body and a drilled bore wall or between a body passage and a control line extending to a further tool, for example a packer.

The member may be movable by application of fluid pressure thereto.

The coupling actuator may include an electric motor. The motor may be linked to a threaded shaft and threaded follower for movement therealong.

These and other aspects of the invention will now be described, by way example, with reference to the accompanying drawings, in which.

Figure 1:
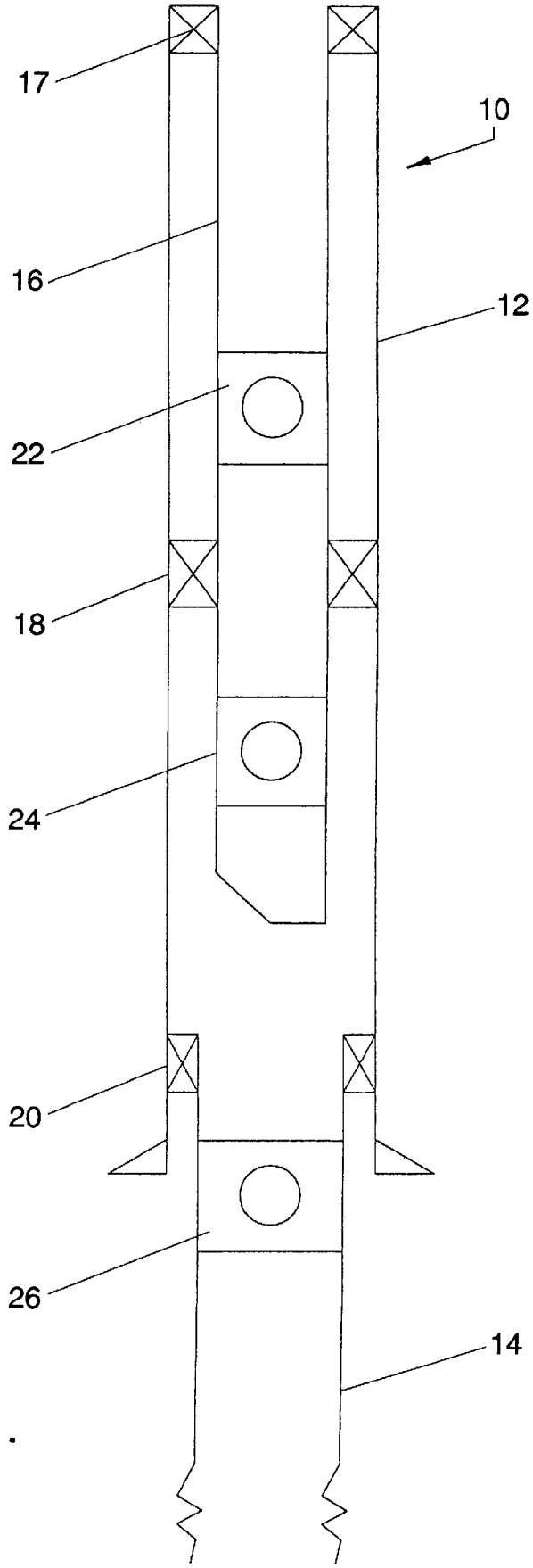
FIG. 1 is a schematic representation of a portion of a well including a tubing test valve, a packer setting valve, and a top of liner test valve.

Reference is first made to FIG. 1 of the drawings which illustrates, somewhat schematically, a section of oil production well bore 10. This environment will be used to describe examples of applications for valves in accordance with embodiments of the present invention. The upper portion of the drilled bore 10 is lined by a steel casing 12. The lower end of the bore 10, which intersects the oil bearing strata, known as the production or pay zone, is provided with a steel liner 14 which is connected to the lower end of the casing 12. Oil is carried to the surface from the production zone through production tubing 16 located within the casing 12. The upper end of the tubing 16 is located relative to the casing 12 by a tubing hanger 17 and lower end of the tubing 16 is located relative to the casing 12 by a packer 18.

Before production from the bore 10 commences, the operator will wish to test the pressure integrity or "completion" of the production tubing 16, inflate the packer 18, and also test the integrity of the annular seals provided by the liner hanger and tubing hanger 20 between the top of the liner 14 and the lower end of the casing. These operations utilise tubing test valve 22, a packer setting valve 24 and a top of liner test valve 26, respectively, in accordance with embodiments of the present invention. Each valve is a normally-closed check valve which allows flow of fluid upwardly as the liner 14 or production tubing 16 is lowered into the bore, but prevents flow of fluid down the bore. The valves are used in sequence as follows. Firstly, the completion of the production tubing 16 is tested by pumping down onto the tubing test valve 22 up to a pressure of 5000 psi. The valve 22 effectively seals the lower end of the tubing 16, such that any loss of pressure indicates a loss of well fluid at some point along the tubing 16. This operation may take place on numerous occasions as new sections of tubing are added at the surface and the end of the tubing 16 moves down through the bore 10. Once the tubing 16 is complete, the tubing test valve 22 may be moved to a fully open position, this feature of the valve being one of the main aspects of the present invention. The packer setting valve 24 is now in fluid communication with the surface, such that fluid may be pumped down the tubing 16 on top of the valve 24, up to 2000 psi, to inflate the packer 18. Once the packer 18 has been set, the valve 24 is moved to the fully-open position. It is now possible to test the integrity of the connection 20, and ensure that the packer 18 has been properly set, by pumping down the production tubing 16 onto the top of liner valve 26. Once testing has been completed the valve 26 is moved to the fully-open position.

Figure 2:
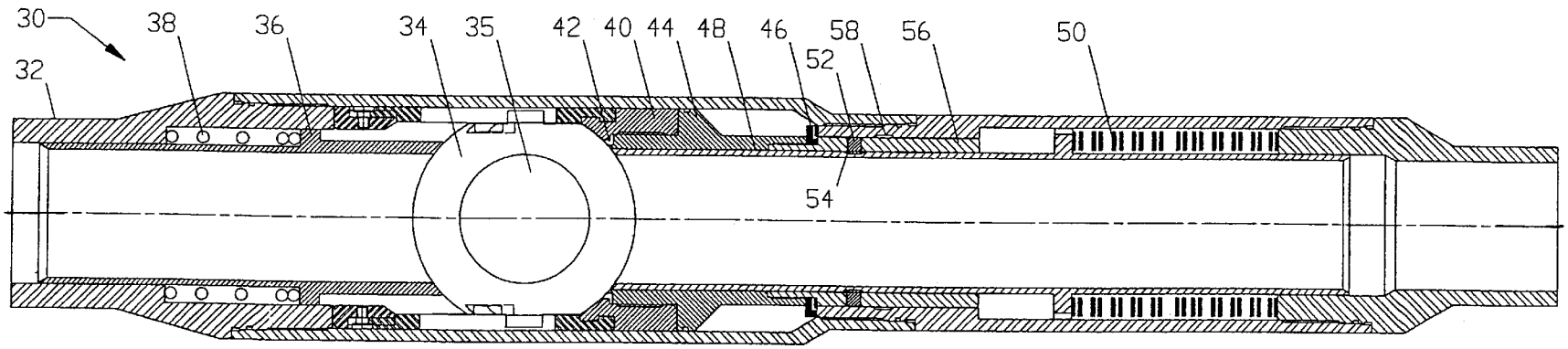
FIG. 2 is a sectional view of a check valve in accordance with a first embodiment of the present invention, suitable for use as a top of liner test valve, shown in a normally-closed first configuration.
Figure 3:
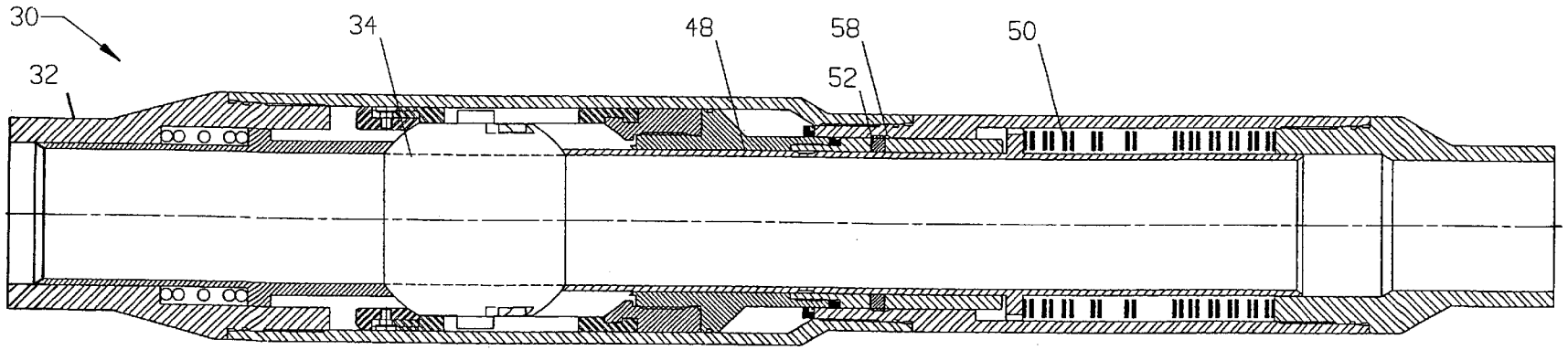
FIG. 3 shows the valve of FIG. 2 in a fully-open second configuration.

Reference is now made to FIGS. 2 and 3 of the drawings, which illustrate a check valve 30 in accordance with a first embodiment of the present invention. The valve 30 is suitable for use as a top of liner test valve 26, as will be described. The valve 30 comprises a tubular body 32 having ends suitable for connection to adjacent liner sections. The body 32 accommodates a ball valve assembly including a ball 34 defining a flow passage 35. A pusher sleeve 36 mounted within the body 32 defines a portion of the flow passage through the body 32 and contacts the upper surface of the ball 34. The sleeve 36 is biased by a spring 38 to push the ball 34 towards the closed position, as illustrated in FIG. 2. When closed, the ball 34 engages a roller seat 40 and a ball seat 42 forming part of a ball valve carriage 43 including a ball cage 45. In normal conditions, further downward movement of the ball 34 is prevented by a ball support sleeve 44 which is supported relative to the valve body 32 by a shear ring 46.

When the valve 30 is run into the bore 10 in the liner 14, the well fluid below the normally-closed valve 30 pushes the ball 34 upwardly such that the ball rotates and well fluid may flow in direction A, through the flow passage 35 and into the liner above the valve 30. Once the liner is in position, and pressure equalises across the valve 30, the ball 34 returns to the closed position. The integrity of the connection 20 and the packer 18 may then be tested by pumping down on the closed valve 30. However, once testing has been completed, the ball 34 may be moved to a fully-open position as described below.

Provided below the ball 34 is a ball retaining sleeve 48 which defines a portion of the valve flow passage. The sleeve 48 is biased upwardly by a spring 50, formed of Bellville washers. However, when the valve 30 is in the normally-closed first configuration, the sleeve 48 is restrained in a first position relative to the ball support sleeve 44 by keys 52 which extend into a groove 54 formed in the outer surface of the sleeve 48, the keys 52 being located within a sleeve 56 connected to the ball support sleeve 44.

To release the ball retaining sleeve 48, pressure is applied in direction B, the applied pressure exceeding the normal test pressure. This pressure acts over the upper surface of the ball 34 to produce a considerable downward pressure force such that the ball and its supporting structure will move downwardly as a "ball piston". The force is selected to be sufficient to compress the spring 50 and to shear the ring 46, permitting the ball support sleeve 44, the key mounting sleeve 56 and the ball retaining sleeve 48 to be pushed downwardly relative to the valve body 32. This movement continues until the trip keys 52 align with a trip key groove 58 formed in a portion of the valve body 32. The trip keys 52 move into the groove 58, thus releasing the ball retaining sleeve 48 from the sleeves 44, 56. Pressure is then bled off from above the ball 34, such that high rate spring 50 pushes the ball 34 upwardly, to rotate the ball to the fully-open position, as illustrated in FIG. 3 of the drawings. Once moved to the fully-open position, the ball 34 does not respond to fluid pressure within the valve 30, such that the ball 34 will remain in the fully open position under the action of the spring 50. However, if considered necessary, a positive locking device, such as a latch, may be provided to hold the ball retaining sleeve 48 in position.

Figure 4:
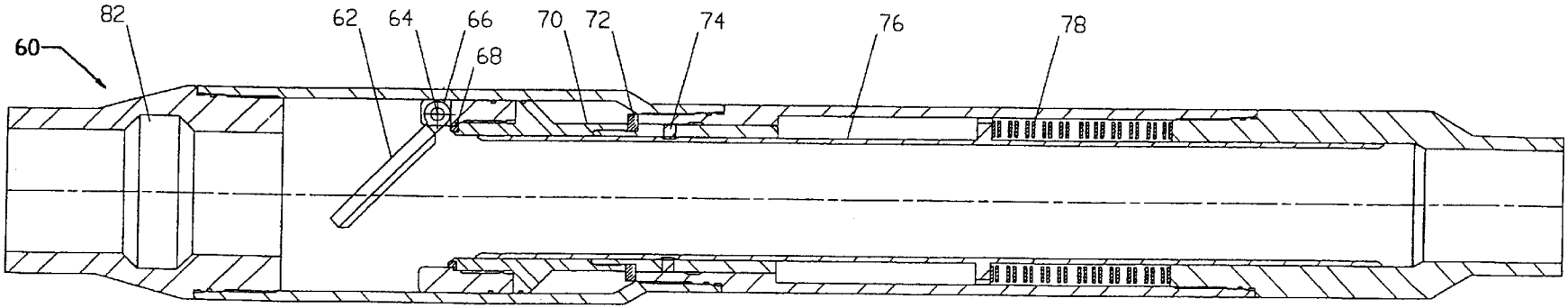
FIG. 4 is a sectional view of a check valve in accordance with a second embodiment of the present invention, suitable for use as a top of liner test valve, and illustrating the valve in a normally-closed first configuration.
Figure 5:
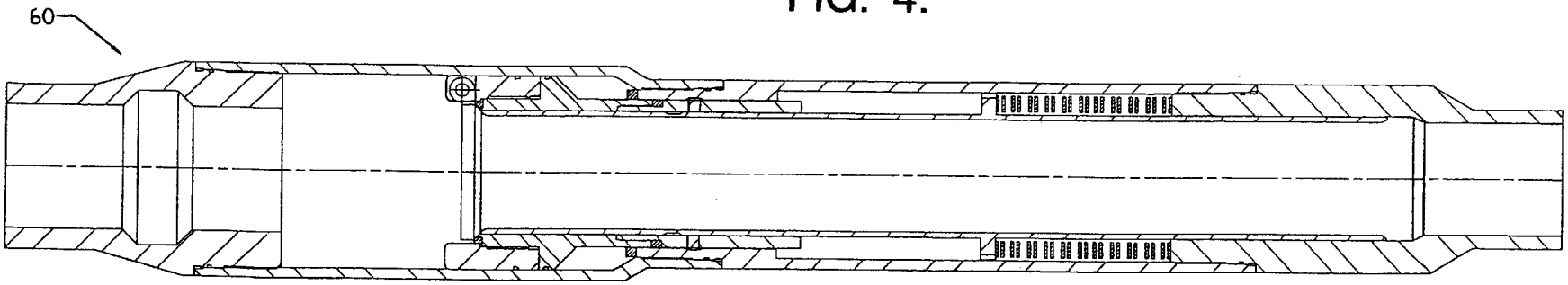
FIG. 5 shows the valve of FIG. 4 moving towards a fully-open second configuration.
Figure 6:
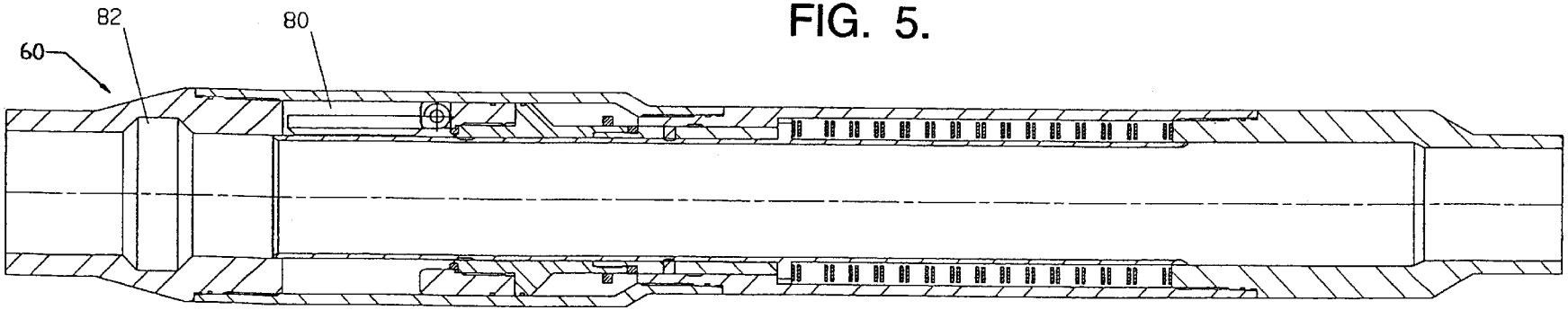
FIG. 6 shows the valve of FIG. 4 in the fully-open second configuration.

Reference is now made to FIGS. 4, 5 and 6 of the drawings, which illustrate a check valve 60 in accordance with a second embodiment of the present invention. This valve 60 is also suitable for use as a top of liner test valve 26. The valve 60 operates in a similar manner to the check valve 30 as described above, however this particular embodiment is in the form of a flapper valve and thus includes a flapper 62 mounted on a pivot pin 64 including a spring 66 which tends to close the flapper 62. The flapper seat 68 is formed at the upper end of a flapper support sleeve 70 itself supported on a shear ring 72, in a similar manner to the valve 30 described above.

As with the valve 30, the check valve 60 may be used in the first normally-closed position to check the integrity of the connection 20 and the packer 18 by pumping down on the normally closed valve. However, to move the valve to the fully-open second configuration, a higher pressure is applied which acts on the upper face of the flapper 62 to move the valve piston downwardly with respect to the valve body. The resulting pressure force shears the ring 72, allowing the valve piston to move downwardly to release trip keys 74 such that the flapper retaining sleeve 76 may be pushed upwardly by the spring 78 and move the flapper 62 to the fully-open position, and also to isolate the flapper within an annular chamber 80, as illustrated in FIG. 6 of the drawings.

In the event that, for some reason, the valve 60 fails to close fully and thus cannot be pushed downwardly by an over pressure to allow release of the flapper retaining sleeve 76, the upper end of the body defines a nipple profile 82 and polished bore to allow a prong to be lowered into the bore and mounted on the valve 60. The probe may then be used to force the flapper 62 to close, and/or push the valve piston downwardly to release the retaining sleeve 76.

Figure 7:
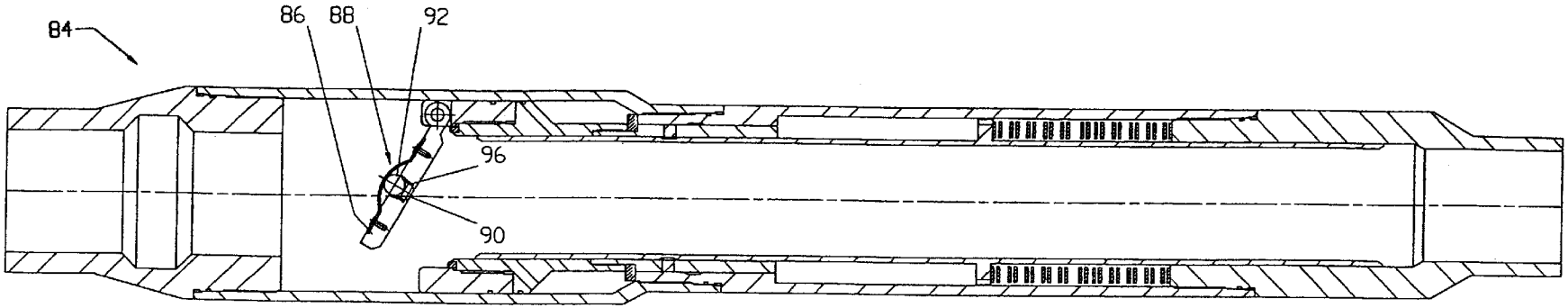
FIG. 7 is a sectional view of a check valve in accordance with a third embodiment of the present invention, suitable for use as a packer setting valve, and showing the valve in a normally-closed first configuration.
Figure 8:
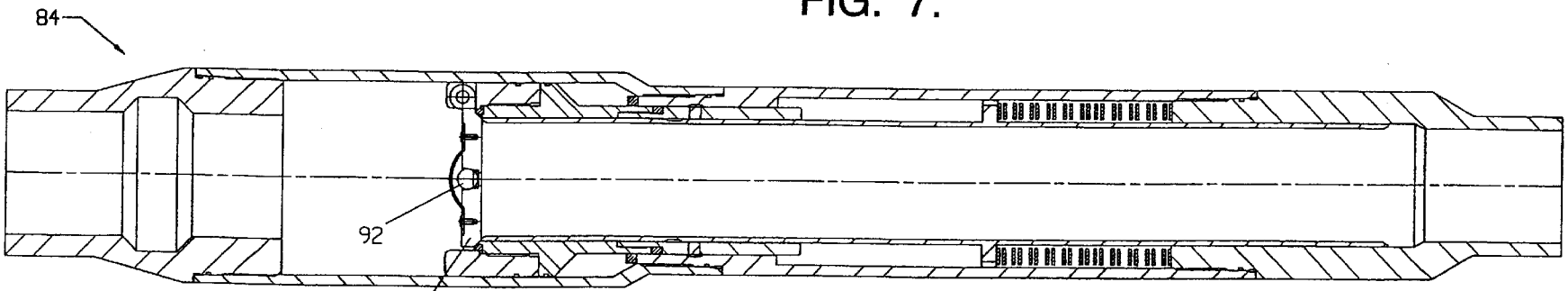
FIG. 8 shows the valve of FIG. 7 moving towards a fully-open second configuration.
Figure 9:
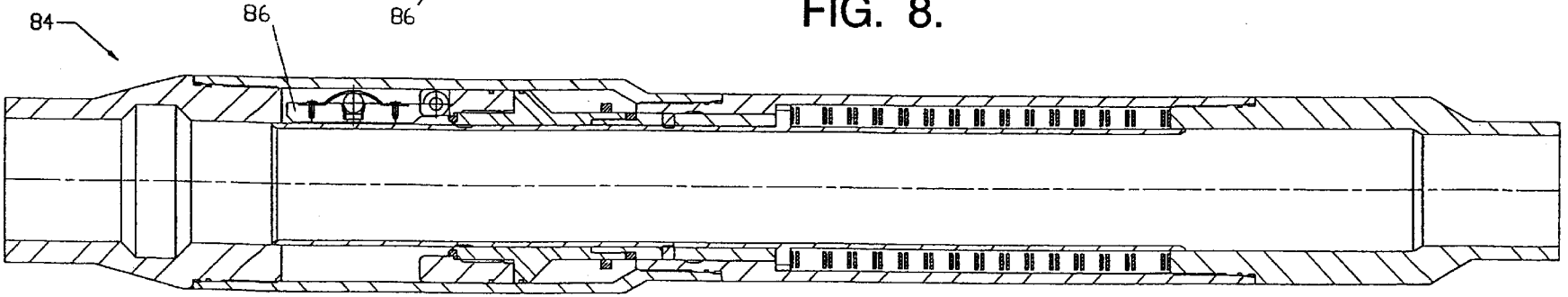
FIG. 9 shows the valve of FIG. 7 in the fully-open second configuration.

A nipple profile and polished bore may be provided on any of the embodiments described herein, and is also illustrated in the embodiment shown in FIGS. 7, 8 and 9.

Reference is now made to FIG. 7, 8 and 9 of the drawings, which illustrate a check valve 84 in accordance with a third embodiment of the present invention. The check valve 84 is generally similar to the check vale 60 described above but is provided with a somewhat different valve flapper 86 such that the valve may be utilised as a packer setting valve 24. The flapper 86 itself accommodates a normally-open valve 88 which comprises a flow passage 90 and a ball 92 restrained within a cage 94. The ball 92 is normally lifted from its seat by a coil spring 96. The ball 92 is formed of a material such as bakelite, or some other brittle material; when the flapper 86 is pushed open, as will be described, the ball will shatter. This allows provision of a relatively large ball, which will provide a more effective seal when closed, and which would otherwise prevent the flapper 86 from moving to the fully-open position within the chamber 80.

The valve 84 is normally-closed, and like the check valves 30, 60 described above, is moved from the normally closed first configuration to the fully-opened second configuration by application of an over pressure. However, as the valve 84 is to be utilised as a packer setting valve 24, the valve 84 will be located below a tubing test valve 22. In use, the tubing test valve 22 will be used in its normally-closed first configuration for testing the completion of the production tubing 16, and then moved to the fully-open second configuration before the valve 84 is used. If, for example, the valve 60 as described above, was used as the packer setting valve 24, there would be a danger that, while the completion of the production tubing 16 was being tested, any leaks past the tubing test valve 22 would result in a build up of pressure between the valves 22, 24, which pressure could be sufficient to set the packer prematurely or to move the packer setting valve to the open second configuration. This potential problem arises, in part, due to the relatively low pressures used to set the packer (2000 psi) and the higher completion testing pressure (5000 psi). This difficulty is avoided by the provision of the normally-open valve 88 in the valve flapper. In the event of leakage past the tubing test valve 22, the small volume of fluid which passes through the valve 22 will simply pass through the normally open valve 88 and thus there will be no pressure build up above the check valve 84. However, once the tubing test valve 22 has been moved to the fully open second configuration, pumping down on the check valve 84, for example at a flowrate of 2 barrels per minute, will push the ball 92 onto its seat and close the flow passage 90. Pressure may then be applied to the valve 84 to set the packer 18, and then a further higher pressure may be applied to the valve 84 to release the flapper retaining sleeve and move the valve to the fully-open second configuration. FIG. 8 of the drawings illustrates the position of the valve piston shortly after it has commenced moving under influence of the over pressure, while FIG. 9 shows the valve in the fully open configuration.

Figure 10:
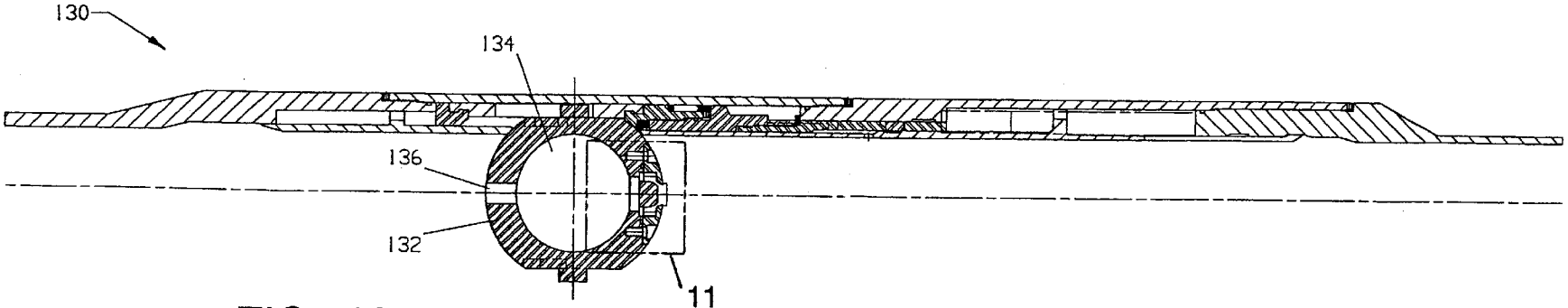
FIG. 10 is a sectional half view of a check valve in accordance with a fourth embodiment of the present invention, suitable for use as a packer setting valve, and showing the valve in a normally-closed first configuration.
Figure 11:
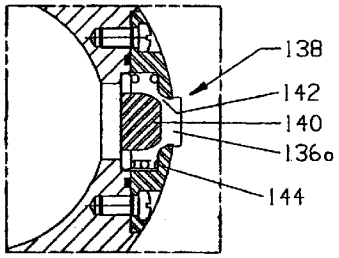
FIG. 11 is an enlarged scrap view of area 11 of FIG. 10.

The embodiment of FIGS. 7, 8 and 9 incorporate a flap valve, but the principle of providing a valve which will not be activated by leakage of the valve above may also be applied to ball valves. Such a check valve 130 is illustrated in FIGS. 10 and 11 of the drawings. It will be noted that the valve 130 includes a ball element 132 defining a flow passage 134 and also a smaller cross-section leakage passage 136 extending normal of the flow passage 134. The passage 136 extends through the walls of the ball 132 on opposite sides of the flow passage 134 and is aligned with the longitudinal axis of the valve body when the valve is in the normally-closed first configuration, as illustrated in FIG. 10. One portion of the passage 136*a* includes a normally-open valve 138 including a valve member 140 normally lifted from a valve seat 142 by a coil spring 144. As with the valve 84 described above, a small volume flow of fluid may pass around the member 140 and thus through the valve 130, whereas any significant flow of fluid with push the valve member 140 against the seat 142, thus permitting a build-up of pressure above the ball 132.

Figure 12:
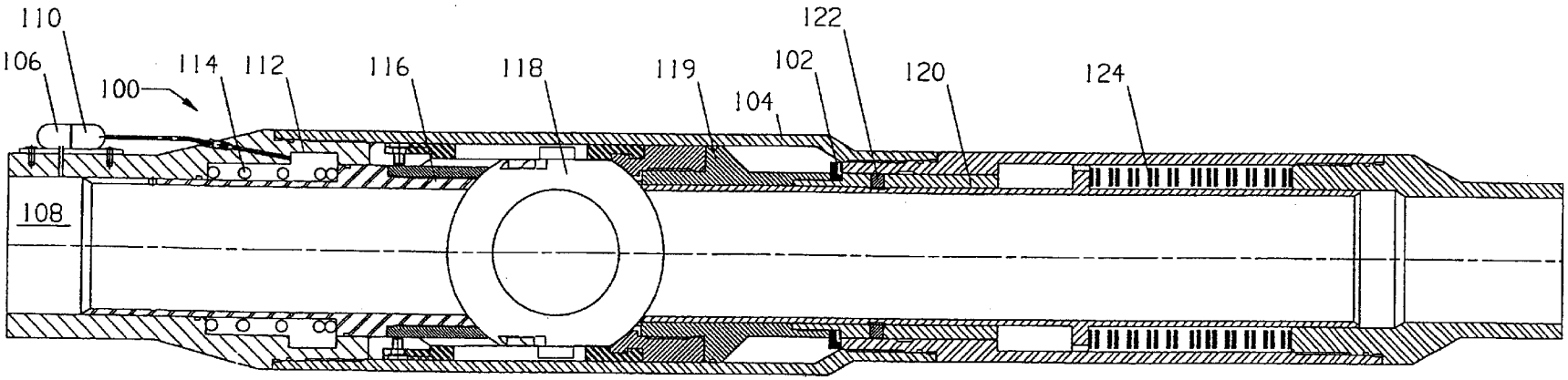
FIG. 12 is a sectional view of a check valve in accordance with a fifth embodiment of the present invention, suitable for use as a tubing test valve, and shown in a normally-closed first configuration.
Figure 13:
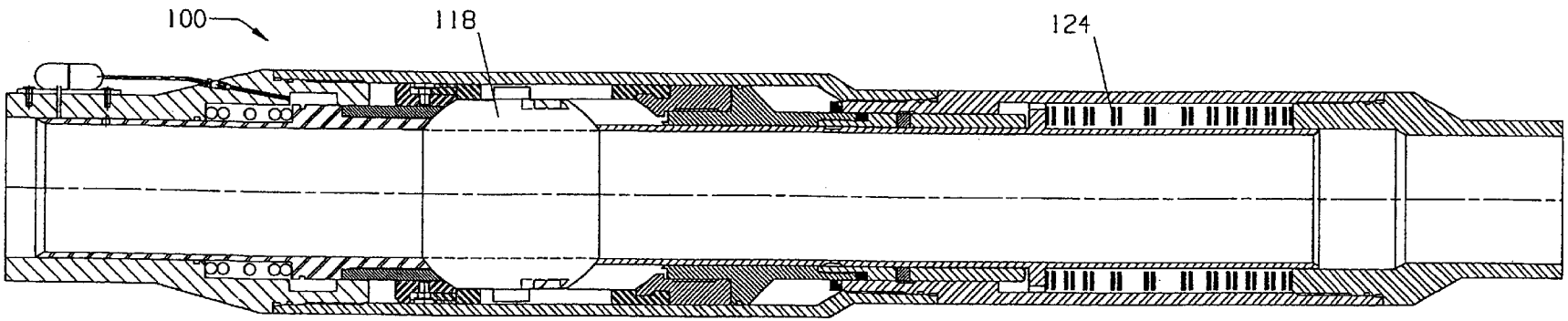
FIG. 13 shows the valve of FIG. 12 in a fully-open second configuration.

Reference is now made to FIGS. 12 and 13 of the drawings, which illustrate a check valve 100 in accordance with a fifth embodiment of the present invention, suitable for use as a tubing test valve 22. The valve 100 is substantially similar to the valve 30 described above. However, for this application the valve 100 will have to withstand completion testing pressures on a number of occasions up to the testing pressure for the tubing 16, typically 5000 psi. Clearly, if the valve 100 was to be moved to the fully-open second configuration by an over pressure this would require that the over pressure was in excess of 5000 psi and above the normally testing limit of the tubing 16. To avoid this difficulty, the valve 100 is provided with other means for moving the valve to the second configuration, as will be described. The higher pressure capability of the valve 100 is accomplished simply by providing a shear ring 102 of a higher rating, for example, one which would withstand application of an over pressure of 6000 psi before shearing.

Mounted towards the upper end of the valve body 104 is an intelligent sensor 106 in fluid communication with the valve flow passage 108. If the sensor 106 detects a predetermined pressure signature (for example 5000 psi for five minutes, then 3000 psi for three minutes) within the flow passage 108, an explosive charge 110 is detonated to create a very high pressure in the chamber 112 which accommodates valve spring 114, and a lower wall of which is formed by the ball pusher sleeve 116. Detonation of the charge 110 results in a high pressure force being applied to the sleeve 116, such that the ball 118 and the lower ball support and retaining sleeves 119, 120 are pushed downwardly to trip the retaining keys 122, allowing the high rated spring 124 to push the ball 118 to the fully-open second configuration, as illustrated in FIG. 13.

Figure 14:
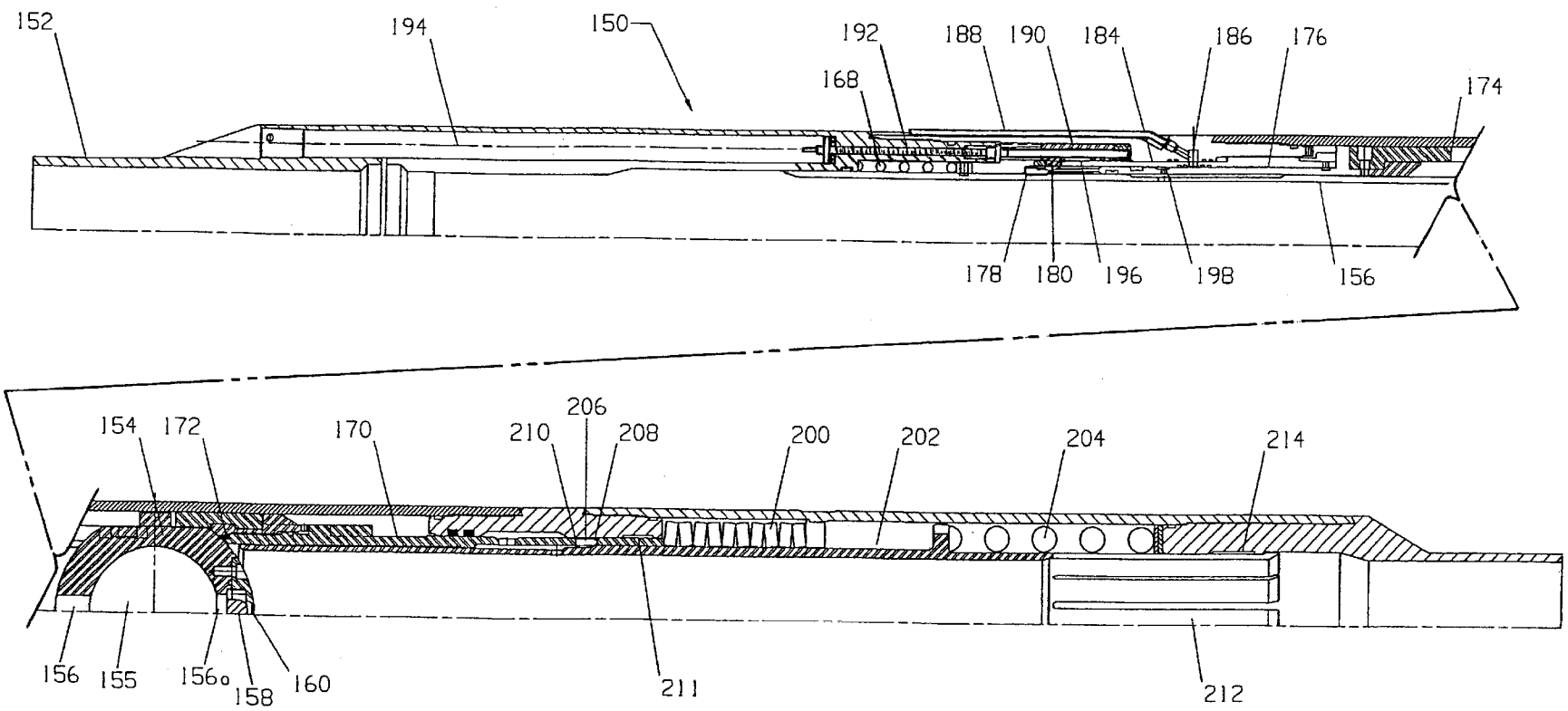
FIG. 14 is a sectional view of a check valve in accordance with a sixth embodiment of the present invention, suitable for use as a packer setting valve and a tubing test valve.

Reference is now made to FIG. 14 of the drawings which illustrates a valve 150 in accordance with a sixth embodiment of the present invention, suitable for use as a packer setting valve and also as a tubing test valve; the valve 150 may be positioned in a similar manner to the packer setting valve 24 as illustrated in FIG. 1, and the presence of the valve obviates the need to provide a separate tubing test valve 22. The valve 150 shares a number of features with the valves described above and comprises a tubular body 152 having ends suitable for connection to adjacent tubing sections. The body 152 accommodates a ball valve assembly including a ball 154 defining a flow passage 155. The ball 154 is similar to the ball element 132 described above and as illustrated in FIGS. 10 and 11 of the drawings, in the that the ball 154 defines a smaller cross-section leakage passage 156 extending perpendicular to the flow passage 155. One portion of the leak passage 156*a* includes a normally-open valve 158 including a valve member 160 normally lifted from a valve seat by a spring. A small volume of fluid may pass around the member 160, whereas any significant flow of fluid will push the valve member 160 against its seat, thus permitting a build-up of pressure above the ball 154.

A pusher sleeve 166 mounted within the body 152 defines a portion of the flow passage through the body 152 and contacts the upper surface of the ball 154. The sleeve 166 is biassed by a spring 168 to push the ball 154 towards the closed position, as illustrated in FIG. 14. When closed, the ball 154 engages a sleeve 170 including a ball seal 172. The sleeve 170 is coupled to a ball cage 174 which is itself coupled to a locking sleeve 176 that extends above the ball 154, between the pusher sleeve 166 and the body 152. The upper end of the sleeve 176 defines spring fingers 178 with enlarged ends which are normally locked relative to the body 152 by engagement with keys 180 located in circumferentially spaced apertures in a sleeve 184 fixed to the body 152. With the ball assembly in the initial normally-closed configuration, the locking sleeve 176 extends across and closes a port 186 in the body sleeve 184, which port 186 communicates with a control line 188 leading to a packer 18 (FIG. 1). As the fingers 178 are locked relative to the body 152 by the keys 180, the ball cage 174 is effectively locked relative to the body 152. However, the ball 154 is free to move upwardly and rotate to an open position, against the action of the spring 168, in response to pressure below the ball 154.

To allow the keys 180 to move radially outwards, to release the ball cage 174 relative to the body 152 such that the valve may be moved to the open configuration, a key support 190 is moved upwardly in the body 152. The key support 190 is mounted on a threaded rod 192 linked to an electrical motor 193 housed within a bore 194 formed in the body 152. The bore 194 also accommodates a suitable power cell for the motor. The electric motor is activated by a sensor which detects pressure pulses in the tubular string, in a similar manner to the embodiment described above and as illustrated in FIGS. 12 and 13. On detecting the predetermined sequence of pressure pulses, sometimes referred to as the pressure signature, the electric motor is activated and rotates the rod 192 to lift the support 190 until the annular groove 196 defined by the support 190 is adjacent the keys 180. Pressurising the tubing above the ball 154 will then cause the sleeve 176, ball cage 174, sleeve 170 and the ball 154 to move downwardly relative to the body 152.

An initial degree of movement brings a port 198 in the locking sleeve 176 into alignment with the port 186 in the body sleeve 184. This allows fluid within the tubing bore to flow through the port 186 and control line 188 to inflate the associated packer.

The lower end of the valve sleeve 170 engages the upper end of a spring in the form of a stack of Bellville washers 200 such that, after release of the fingers 178, the pressure force applied to the ball "piston" must be sufficient to compress the stack 200 before the ball 154 and valve assembly will move downwards.

In common with the other ball valves embodiments described above, a ball retaining sleeve 202 is provided below the ball 154 and defines a portion of the valve flow passage. The sleeve 202 is biassed upwardly by a compression spring 204. However, the sleeve 202 is initially restrained in a first position relative to the ball support sleeve 170 by keys 206 which engage a shoulder 208 formed in the outer surface of the sleeve 202, the keys 206 being located in apertures 210 formed in the lower end of the ball support sleeve 170; once the locking sleeve 176 has been released from the body 152 as described above, the valve 150 is opened in a similar manner to the ball valve embodiments as described above, that is the sleeves 170, 202 are pushed downwards until the keys 206 move out into a lower groove 211 formed in a portion of the body, permitting the sleeve 202 to move upwards, under the influence of the spring 204, relative to the sleeve 170 and ball cage 174, to push the ball into the open position.

The valve 150 also includes a lock open feature, the lower end of the sleeve 202 defining fingers 212 which engage in an annular slot 214 formed in the inner wall of the body 152 when the sleeve 202 is moved upwardly, and thus prevent the sleeve 202 from being moved downwardly relative to the body 152.

Figure 15:
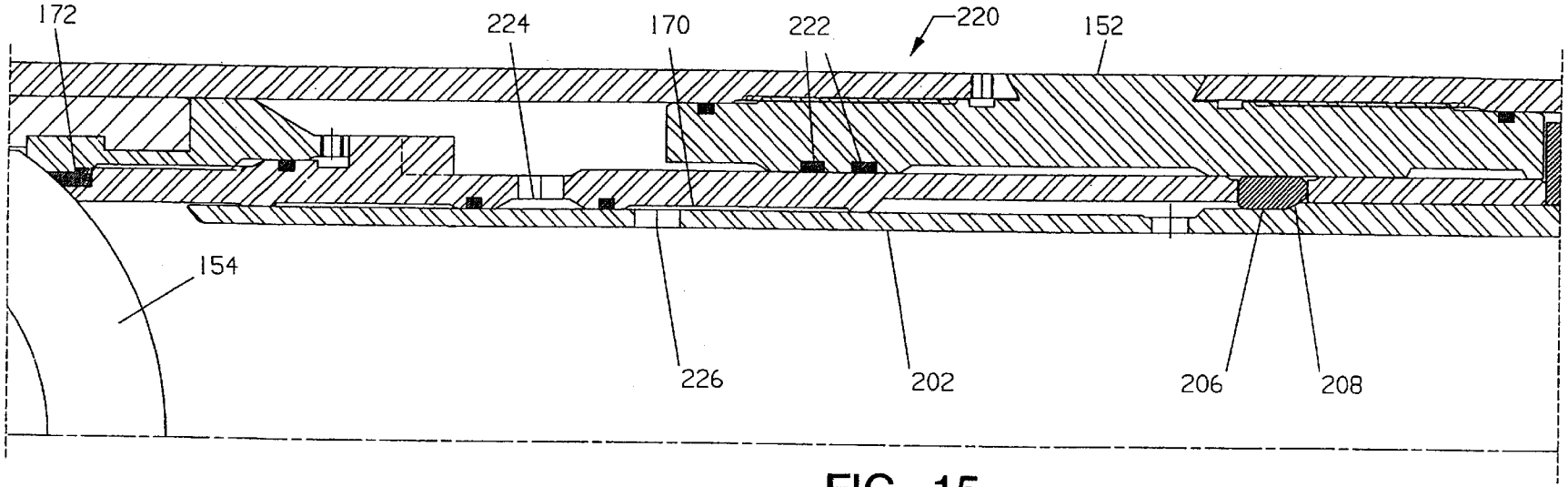
FIGS. 15 and 16 are sectional scrap views of a part of a check valve in accordance with a seventh embodiment of the present invention.
Figure 16:
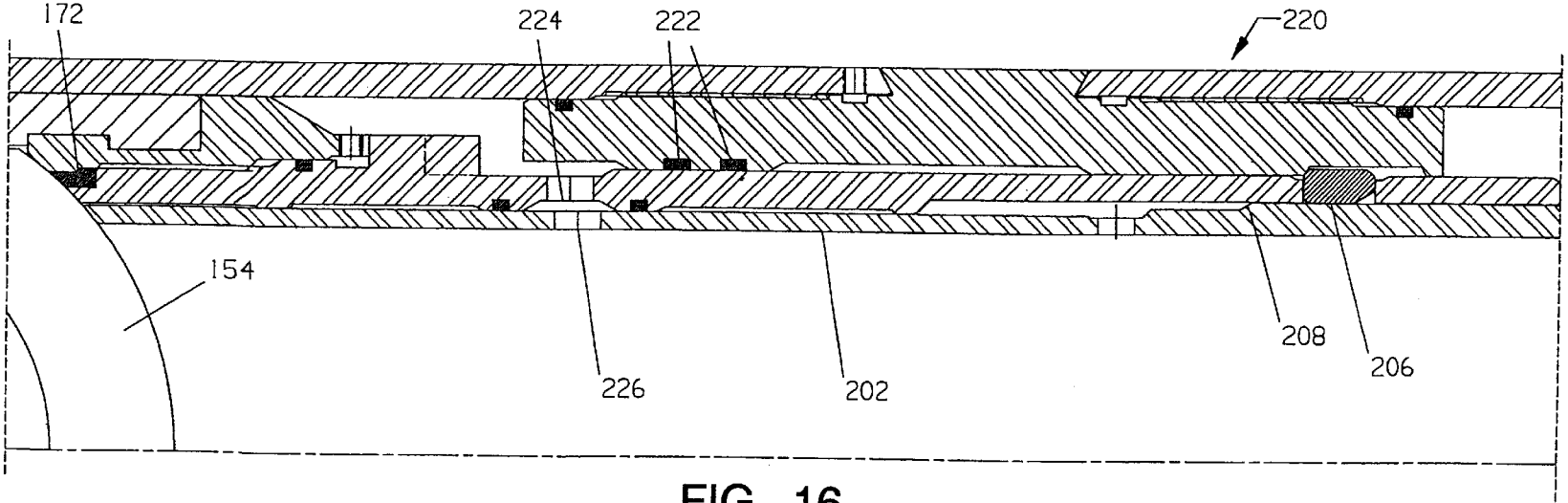
Figure 1:
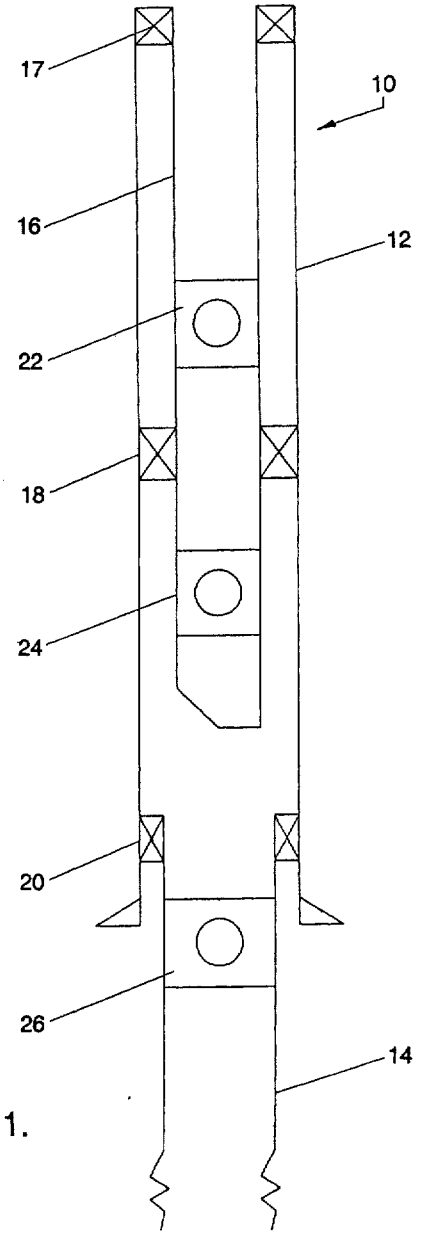
Figure 2:
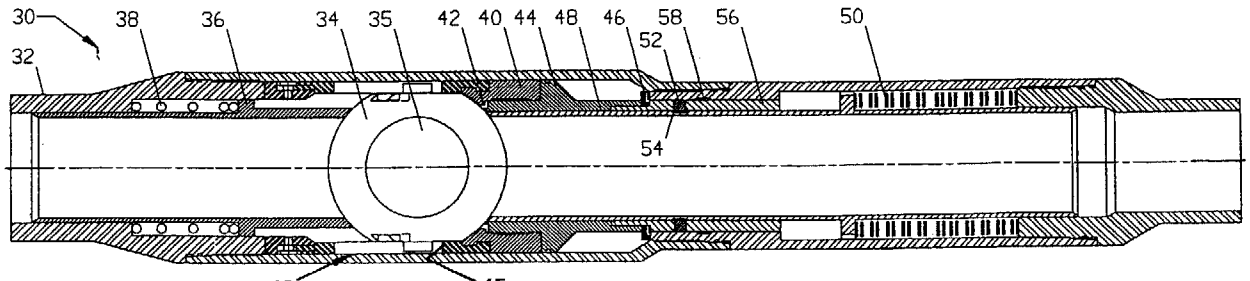
Figure 3:
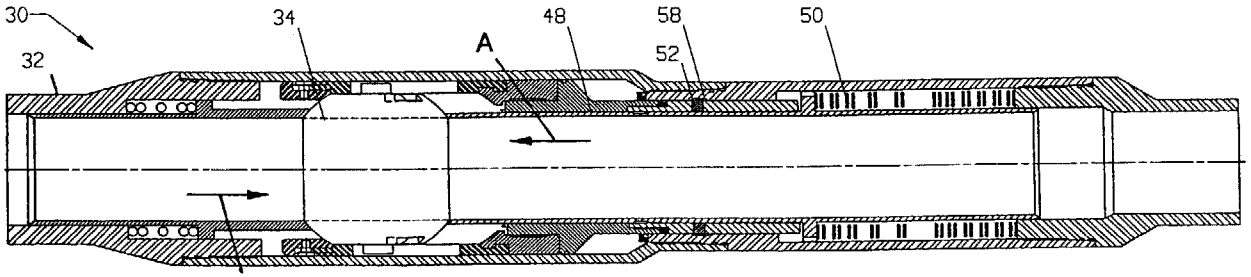
Figure 4:
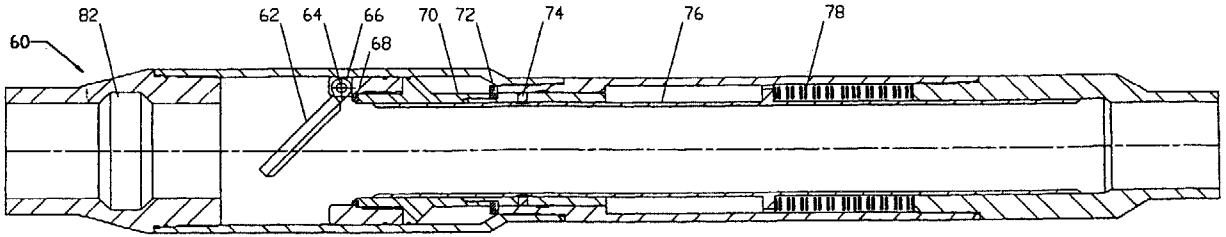
Figure 5:
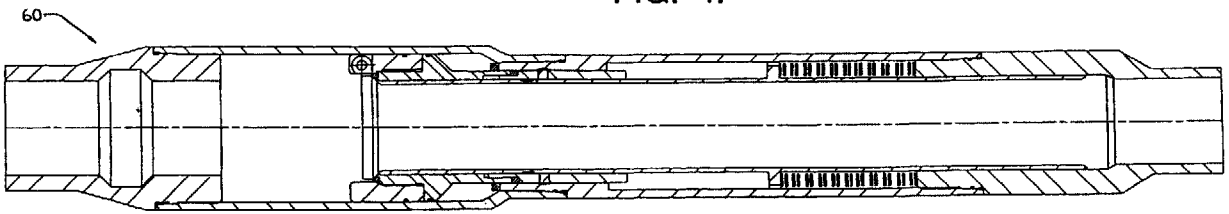
Figure 6:
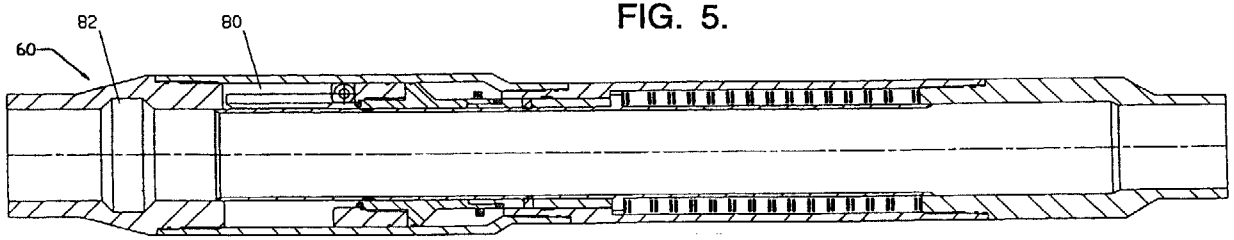
Figure 7:
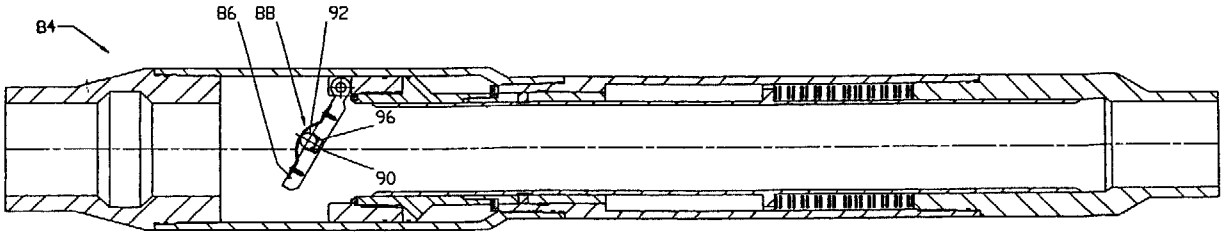
Figure 8:
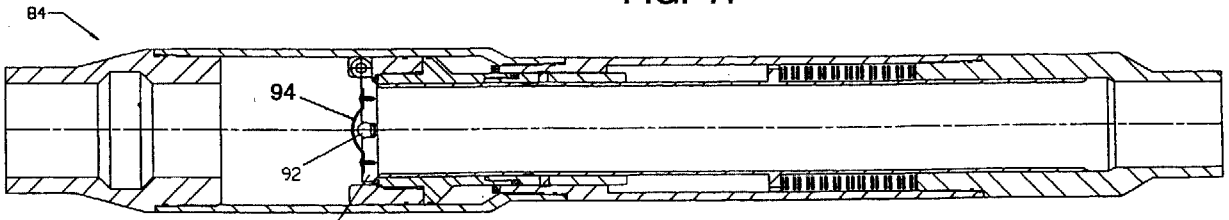
Figure 9:
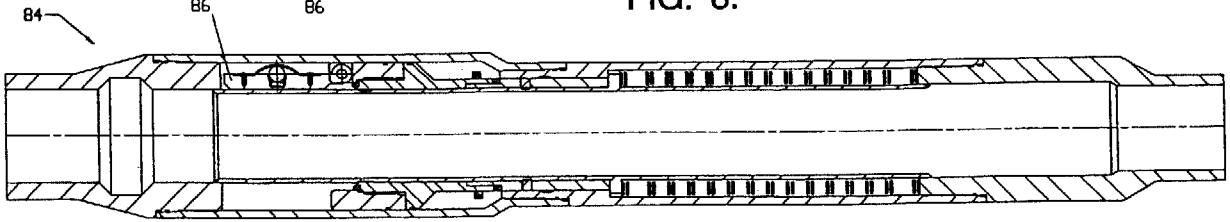
Figure 10:
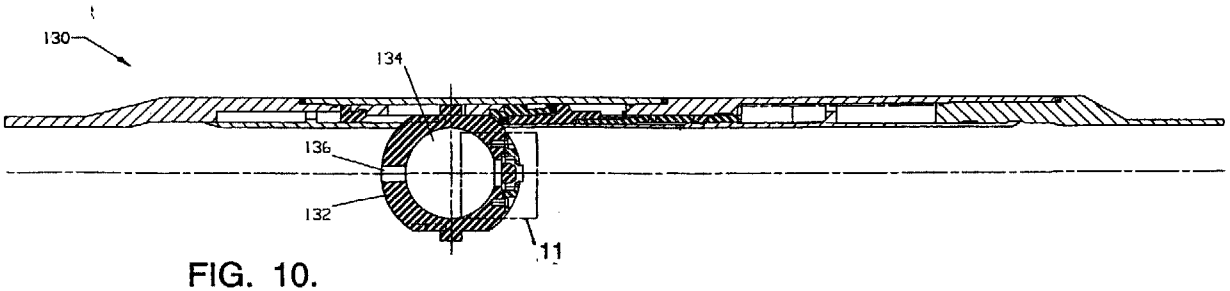
Figure 11:
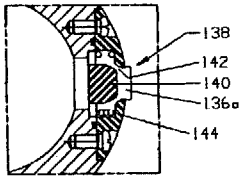
Figure 12:
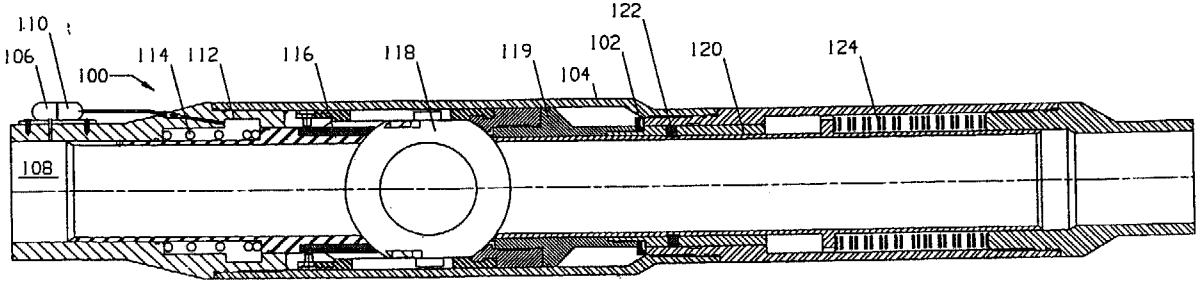
Figure 13:
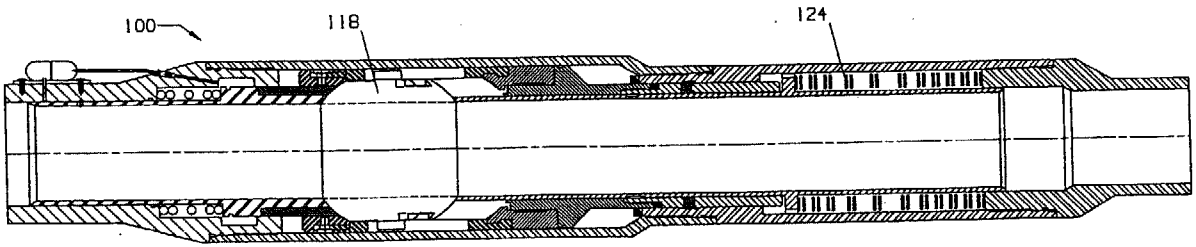
Figure 14:
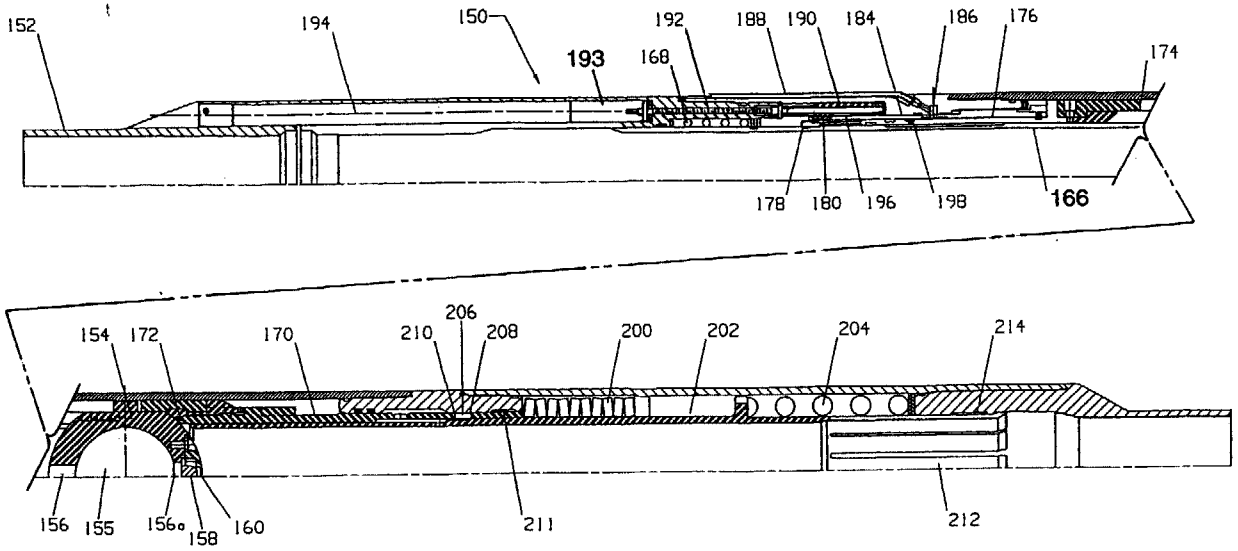
Figure 15:
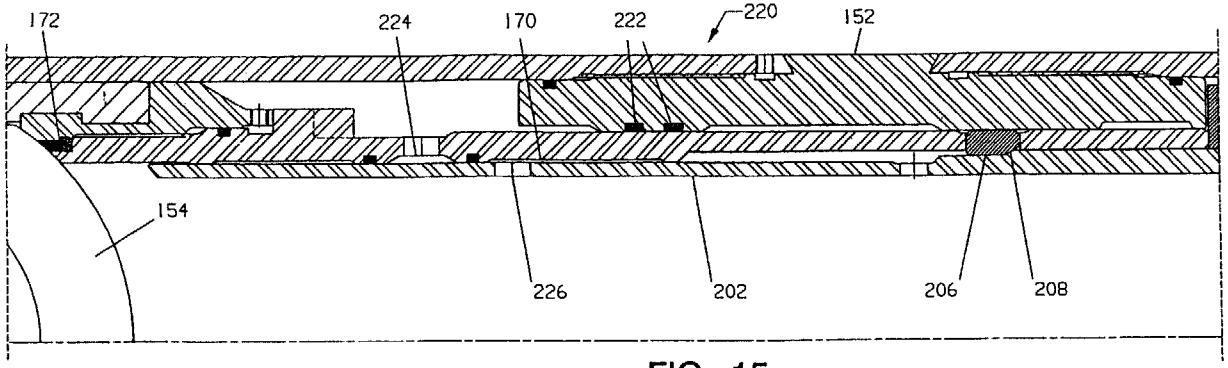
Figure 16:
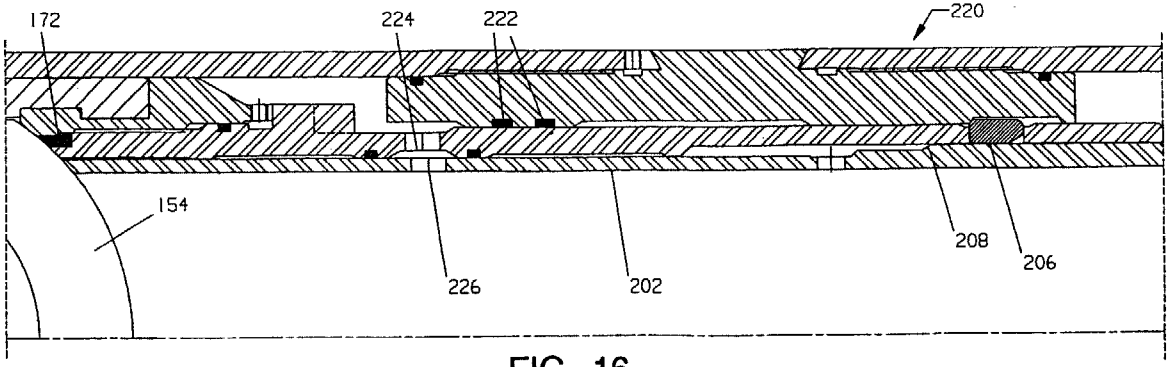

Reference is now made to FIGS. 15 and 16 of the drawings, which illustrate part of a check valve 220 in accordance with a seventh embodiment of the present invention. The valve 220 is substantially similar to the valve 150 described above and operates in a substantially similar manner and common reference numerals will be used to identify the corresponding elements of the valve 220. The primary difference between the valves is the manner in which the valve opens once the sleeve 202 has been released; in the valve 150, and the other valves described above, the spring 204 pushes the sleeve 202 upwardly and rotates the ball 154 once the pressure utilised to push the valve assembly downwards to release the sleeve 202 has been bled off at the surface. However, in the valve 220 a fluid equalising path is provided to permit pressure equalisation across the ball 154, as described above.

FIG. 15 illustrates the valve 220 in the first configuration, with the sleeve 202 restrained against upward movement relative to the sleeve 170 by the retaining key 206 engaging the shoulder 208. With the valve in the first configuration, the lower surface of the ball 154 contacts the sleeve valve seal 172, while sleeve 170 is in sealing contact with the body 152 via a pair of body-mounted 'T' seals 222 (it will be noted that a similar sealing arrangement is present in the valve 150 described above). However, as the sleeve 202 is released and moves upwards under the influence of the high-rated spring 204 (not shown in FIGS. 14 and 15) it is desired to provide a fluid path around the ball 154 to permit pressure equalisation across the ball. To this end, the sleeve 170 defines a port 224 intermediate to seals 172, 222 which, when the sleeve 202 is restrained relative to the sleeve 170, is closed by a portion of the sleeve 202. However, on release of the sleeve 202 and following a degree of relative upward movement of the sleeve 202, a port 226 in the sleeve 202 is brought into alignment with the port 224, as illustrated in FIG. 16: this provides a fluid path around the ball 154. When the upward force provided by the spring 204 is greater the remaining downward pressure force on the ball 154, the sleeve 202 pushes the ball 154 into the open position.

This feature may be incorporated in any of the other valves described above, and offers a number of advantages, in particular the equalisation feature facilitates opening of the valve when the pressure force created by the column of fluid in the tubing above the valve exceeds the pressure in the well fluid below the valve.

It will be clear to those of skill in the art that the above-described embodiments are merely exemplary of the present invention, and that various modifications and improvements may be made thereto, without departing from the scope of the invention.

What is claimed is:

1. A downhole valve including:

a body defining a flow passage;

a valve assembly mounted in the body, the valve assembly including a valve member being movable from a first configuration to a second configuration, in the first configuration the valve member preventing flow in at least one direction through the passage, and in the second configuration the valve member being retained in an open position;

a valve member retainer normally restrained in a first configuration and biassed for movement to a second configuration, the retainer being held in the first configuration while the valve member is in the first configuration and being releasable from said first configuration, by axial movement of the valve assembly relative to the valve body, to move the valve member to the open position and retain the valve member in the open position; and a coupling arrangement including a retractable coupling member for initially coupling the valve assembly to the body to prevent relative movement therebetween, whereby retraction of the coupling member permits uncoupling, and thus permits release of the valve member retainer.

2. The valve of claim 1, wherein, in the first configuration, the valve member is normally closed and will hold pressure from said one direction but will open in response to pressure from the opposite direction.

3. The valve of claim 1, wherein the valve member retainer is biassed towards its second configuration by a spring.

4. The valve of claim 1, wherein the axial movement of the valve assembly releases a trip coupling.

5. The valve of claim 1, wherein the axial movement is achieved by application of a pressure force to the valve member or to a portion of the valve assembly.

6. The valve of claim 4, wherein the pressure force is applied directly in the valve member by fluid in the valve body.

7. The valve of claim 1, wherein said axial movement of the valve assembly relative to the body is resisted by a biassing member.

8. The valve of claim 7, wherein the biassing member is pre-stressed such that the degree of axial movement necessary to release the valve member retainer is only obtained by application of a pressure above a predetermined level.

9. The valve of claim 1, wherein the coupling arrangement includes a shear coupled that will release on application of a predetermined force.

10. The valve of claim 1, wherein a coupling member actuator is provided and is remotely activatable to permit uncoupling.

11. The valve of claim 10, wherein the coupling member actuator is an electric motor.

12. The valve of claim 10, wherein the coupling member actuator is activated by pressure pulses.

13. The valve of claim 1 wherein the valve assembly includes a portion for initially closing a port in the wall of the body, which port communicates with a control line linked to a packer or other fluid actuated downhole tool, the valve assembly portion being movable to permit fluid flow through the port from the body passage.

14. A downhole valve including:

a body defining a flow passage;

a valve assembly mounted in the body, the valve assembly including a valve member being movable from a first configuration to a second configuration, in the first configuration the valve member preventing flow in at least one direction through the passage, and in the second configuration the valve member being retained in an open position;

a valve member retainer normally restrained in a first configuration and biassed for movement to a second configuration, the retainer being held in the first configuration while the valve member is in the first configuration and being releasable from said first configuration, by axial movement of the valve assembly relative to the valve body, to move the valve member to the open position and retain the valve member in the open position; and a biassing member for resisting said axial movement of the valve assembly relative to the body.

15. A downhole valve including:

a body defining a flow passage;

a valve assembly mounted in the body, the valve assembly including (a) a valve member being movable from a first configuration to a second configuration, in the first configuration the valve member preventing flow in at least one direction through the passage, and in the second configuration the valve member being retained in an open position, (b) a portion for initially closing a port in the wall of the body, which port communicates with a control line linked to a packer or other fluid actuated downhole too, the valve assembly portion being movable to permit fluid flow through the port from the body passage; a valve member retainer normally restrained in a first configuration and biassed for movement to a second configuration, the retainer being held in the first configuration while the valve member is in the first configuration and being releasable from said first configuration to move the valve member to the open position and retain the valve member in the open position.

16. The valve of claim 15, wherein the valve member retainer is releasable from its first configuration by axial movement of the valve assembly relative to the valve body.

17. The valve of claim 1 wherein the valve assembly includes a valve member carriage and the released retainer is movable relative thereto.

18. The valve of claim 17, wherein the valve member is a ball and the carriage includes a ball cage and the retainer is movable relative to the cage, following release of the retainer from the first configuration.

19. The valve of claim 1, wherein the retainer includes an axially movable sleeve defining a portion of the valve flow passage.

20. The valve of claim 19, wherein the valve is a ball valve and an end of the sleeve bears on the ball surface to push the ball to the open position.

21. The valve of claim 19, wherein the valve member is in the form of one or more flappers and an end of the sleeve is utilised to push the flappers to the open position and then define the flow passage past the flappers.

22. The valve of claim 1 wherein the valve is configurable to permit limited flow of fluid in said one direction by providing a further valve including a normally open valve member which remains open where there is only a limited flow in said one direction, but closes in response to a higher rate of flow.

23. The valve of claim 22, wherein said further valve includes a valve member which is normally lifted from its seat by a spring, such that fluid may pass around the member, a higher flow creating a pressure force on the valve member and overcoming the spring force to close the valve.

24. The valve of claim 22, wherein said further valve is provided in the valve member of said valve assembly.

25. The valve of claim 1 further comprising means for equalising pressure across the valve member, said means defining a fluid path for providing fluid communication across the valve member following release of said valve member retainer from the first configuration.

26. A downhole check valve comprising:

a body defining a flow passage and;

a valve assembly mounted in the body, the valve assembly including: a primary valve member being movable from a first configuration to a second configuration, in the first configuration the valve member preventing flow in at least one direction through the passage, and in the second configuration the valve member being retained in an open position; and a normally open secondary valve member configured to permit flow in said one direction through said primary valve member up to a predetermined rate and being closed by fluid forces in the event of the flow rate approaching said predetermined rate.

27. The valve of claim 26, wherein the secondary valve member is located on the primary valve member and controls flow through a passage extending therethrough.

28. Downhole apparatus including:

a body;

a member mounted on the body and being movable relative thereto;

a coupling between the body and the member, in a first configuration the coupling preventing movement of the member relative to the body and in a second configuration the coupling permitting such movement;

a coupling actuator for moving the coupling from the first to the second configuration;

a sensor operatively associated with the coupling actuator and for activating the actuator on detection of a predetermined activation signal, wherein the member forms part of a valve, the valve being locked in a closed first configuration by the coupling and being movable to an open second configuration on re-configuring of the coupling.

29. The apparatus of claim 28, wherein the valve controls flow of fluid through an axial passage defined by the body.

30. The apparatus of claim 28, wherein the valve controls flow of fluid through a wall of the body.

31. Downhole apparatus including:

a body;

a member mounted on the body and being movable relative thereto;

a coupling between the body and the member, in a first configuration the coupling preventing movement of the member relative to the body and in a second configuration the coupling permitting such movement;

a coupling actuator for moving the coupling from the first to the second configuration;

a sensor operatively associated with the coupling actuator and for activating the actuator on detection of a predetermined activation signal, wherein the member is movable by application of fluid pressure thereto.

32. Downhole apparatus including:

a body;

a member mounted on the body and being movable relative thereto;

a coupling between the body and the member, in a first configuration the coupling preventing movement of the member relative to the body and in a second configuration the coupling permitting such movement;

a coupling actuator for moving the coupling from the first to the second configuration;

a sensor operatively associated with the coupling actuator and for activating the actuator on detection of a predetermined activation signal, wherein the coupling actuator include an electric motor linked to a threaded shaft and threaded follower for movement therealong.

* * * * *

UNITED STATES PATENT AND TRADEMARK OFFICE
CERTIFICATE OF CORRECTION

PATENT NO. : 6,125,930

DATED : October 3, 2000

INVENTOR(S) : Moyes

It is certified that error appears in the above-identified patent and that said Letters Patent is hereby corrected as shown below:

In the drawings, sheets 1-8 should be deleted to be substituted with the attached sheets 1-8, as shown on the attached pages.

Column 11, line 45, "claim 4" should read --claim 5--; line 46, "in", first occurrence, should read --to--; line 56, "coupled" should read --coupling--; line 63, "claim 10" should read --claim 11--.

Column 12, line 36, "too" should read --tool--.

Column 13, line 18, "and;" should read --; and--.

Column 14, line 41, "include" should read --includes--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*